US008985483B2

(12) United States Patent
Petrovic

(10) Patent No.: US 8,985,483 B2
(45) Date of Patent: Mar. 24, 2015

(54) ADJUSTABLE TRAJECTORY SPRAY NOZZLES

(76) Inventor: John E. Petrovic, Fort Collins, CO (US)

( * ) Notice: Subject to any disclaimer, the term of this patent is extended or adjusted under 35 U.S.C. 154(b) by 0 days.

(21) Appl. No.: 13/540,867

(22) Filed: Jul. 3, 2012

(65) Prior Publication Data

US 2013/0186972 A1 Jul. 25, 2013

Related U.S. Application Data

(60) Provisional application No. 61/590,008, filed on Jan. 24, 2012.

(51) Int. Cl.

| | |
|---|---|
| ***A62C 31/02*** | (2006.01) |
| ***B05B 1/18*** | (2006.01) |
| ***B05B 1/16*** | (2006.01) |
| ***B05B 1/26*** | (2006.01) |

(52) U.S. Cl.

CPC ..... *B05B 1/18* (2013.01); *B05B 1/1636* (2013.01); *B05B 1/262* (2013.01)

USPC ..... 239/396; 239/11; 239/394; 239/395; 239/437; 239/490; 239/533.13; 239/533.14

(58) Field of Classification Search

CPC ..... B05B 1/262; B05B 1/1636; B05B 1/18

USPC ..... 239/11, 394, 395, 391, 396, 422–449, 239/581.1, 490, 491, 533.13, 533.14

See application file for complete search history.

(56) References Cited

U.S. PATENT DOCUMENTS

| | | | | |
|---|---|---|---|---|
| 3,691,584 | A | 9/1972 | Landers | |
| 3,776,460 | A | 12/1973 | Fichter | |
| 4,026,470 | A | 5/1977 | Crist | |
| 4,346,844 | A | 8/1982 | Harmony | |
| 4,394,965 | A | 7/1983 | Backe et al. | |
| 4,962,886 | A | 10/1990 | Stockel | |
| 5,060,867 | A | 10/1991 | Luxton et al. | |
| 5,228,625 | A * | 7/1993 | Grassberger | 239/558 |
| 5,344,080 | A | 9/1994 | Matsui | |
| 5,507,436 | A | 4/1996 | Ruttenberg | |
| 5,577,664 | A | 11/1996 | Heitzman | |
| 6,463,658 | B1 * | 10/2002 | Larsson | 29/890.142 |
| 6,722,586 | B2 | 4/2004 | Bonse et al. | |
| 6,805,164 | B2 | 10/2004 | Stouffer | |
| 7,111,800 | B2 | 9/2006 | Berning et al. | |
| 7,278,591 | B2 | 10/2007 | Clearman et al. | |
| 2003/0062426 | A1 * | 4/2003 | Gregory et al. | 239/107 |

(Continued)

*Primary Examiner* — Len Tran
*Assistant Examiner* — Joel Zhou
(74) *Attorney, Agent, or Firm* — Paul M. Thompson; Cochran Freund & Young LLC

(57) ABSTRACT

Disclosed is a method and device to control a spray pattern produced from a spraying device consisting of a plurality of individual jets that form the resulting spray pattern. The trajectory of each individual jet is controlled by orienting the nozzle-like feature that produces each individual jet, thereby producing a variety of spray patterns. This is accomplished utilizing the flexible properties of elastomeric or rubber-like materials. In addition to allowing for deformation or movement to remove possible obstructions to the fluid flow, this flexibility property also permits for specific, controlled movements, whereby it is possible to control the trajectory of the fluid issuing from the device. These rubber-like materials can include specific features that allow the material to be deformed in a controlled fashion so as to predictably control the trajectory of the streams issuing from the individual nozzles.

10 Claims, 15 Drawing Sheets

(56) References Cited

U.S. PATENT DOCUMENTS

| | | | | |
|---|---|---|---|---|
| 2005/0000581 | A1 | 1/2005 | Lane et al. | |
| 2005/0061896 | A1 | 3/2005 | Luettgen et al. | |
| 2005/0263617 | A1 | 12/2005 | Thong | |
| 2005/0284967 | A1* | 12/2005 | Korb et al. | 239/552 |
| 2006/0157590 | A1* | 7/2006 | Clearman et al. | 239/383 |
| 2006/0219821 | A1 | 10/2006 | Okuma | |
| 2007/0246577 | A1* | 10/2007 | Leber | 239/589 |
| 2011/0084153 | A1* | 4/2011 | Qiu et al. | 239/562 |

* cited by examiner

ADJUSTABLE TRAJECTORY SPRAY NOZZLES

CROSS REFERENCE TO RELATED APPLICATION

This application is based upon and claims the benefit of U.S. provisional application No. 61/590,008, entitled "Adjustable Trajectory Spray Nozzles" filed Jan. 24, 2012, and the entire disclosures of which is hereby specifically incorporated by reference for all that it discloses and teaches.

BACKGROUND OF THE INVENTION

It is common for most spray devices such as showers, garden sprayers, etc. to offer the user a device which has more than one spray pattern. Most typically these devices provide for the use of multiple spray patterns by selection of alternate sets of outlet flow nozzles or orifices. Potential disadvantages of using alternate sets of outlets are the added difficulty of manufacturing control for each set, additional space required in the device for each set of orifices, generally the use of more sealing members to prevent undesired leakage between set of orifices, and additional parts to permit the selection of each set of orifices, etc.

In some cases, these sets of outlet flow nozzles or orifices may consist of just one nozzle or orifice. In other cases, the outlet set will consist of multiple individual orifices, each producing its own individual jet. Advantages of outlet sets consisting of multiple individual orifices are droplet size, which is better controlled, and the distribution of the issuing fluid can be more predictably controlled. These advantages provide particular value for the personal shower user where certain spray droplet sizes and distribution of these droplets can provide for a more enjoyable showering experience.

In recent years, shower manufacturers, in particular, have employed elastomeric or rubber-like materials in their products as part of the product to produce the final spray patterns. One reason for doing this is that if particles block the spray opening or deposits, i.e. mineral-type, collect in the vicinity of the opening, these obstructions can be removed by deforming the rubber-like feature. Generally, these rubber-like materials are used in conjunction with other more rigid materials to support the flexible material against the imposing fluid pressure. Without the use of more rigid materials, the elastomeric or rubber material is likely to excessively deform and render the product unusable with higher fluid pressures.

SUMMARY OF THE INVENTION

An embodiment of the present invention may therefore comprise: a fluid spray control device that produces a variety of fluid spray patterns comprising: a housing that forms an enclosed flow path interface between a pressurized fluid source and at least one flexible member comprising at least one flexible flow channel, the flexible flow channel having an inlet, a protruded, approximately cylindrical axis with a length which is greater than diameter, and an outlet thereby forming a nozzle; a manifold within the housing that distributes the fluid to at least one nozzle; a rigid support plate that supports and retains the flexible member with the manifold; a deflecting member that when engaged, contacts at least a portion of the flexible flow channel to deflect the direction of the flow channel thereby changing the angle of trajectory of the fluid exiting the nozzle.

An embodiment of the present invention may also comprise: a hand shower device that produces a variety of fluid spray patterns comprising: a housing that forms an enclosed flow path interface between a pressurized fluid source and a flexible member comprising a disk containing a plurality of flexible flow channels, the flexible flow channels each having an inlet, a protruded cylindrical axis with a length which is greater than diameter, and an outlet thereby forming individual nozzles that extend beyond the distal surface of the disc; a manifold within the housing that supplies the fluid into the nozzles; a rigid support plate that supports and retains the flexible member with the manifold; a deflecting member that that when engaged, contacts some or all of the flexible flow channels to deflect the direction of the flow channels thereby changing the angle of trajectory of the fluid exiting the nozzles; an alignment member that contacts the flexible flow channels and allows limited and specific deflection angles and position of the flexible flow channels; a lower support member that retains the alignment member, the deflecting member, the rigid support plate and the manifold with the housing.

An embodiment of the present invention may therefore comprise: a method of producing a variety of fluid spray patterns that issue from a plurality of flexible nozzles comprising: introducing a fluid under pressure to a manifold that distributes the fluid to a flexible member; supporting and retaining the flexible member to the manifold with a rigid support plate; flowing the fluid through the plurality of flexible flow channels in the flexible member; producing a first fluid spray pattern of the fluid exiting the nozzles with the flexible flow channels each having an inlet, a protruded cylindrical axis with a length which is greater than diameter, and an outlet thereby forming individual nozzles; contacting some or all of the flexible flow channels with a deflecting member to deflect some or all of the flow channels to a modified angle of trajectory; producing a second fluid spray pattern of the fluid exiting the nozzles with the flexible flow channels that have been deflected with the deflecting member to the modified angle of trajectory.

BRIEF DESCRIPTION OF THE DRAWINGS

In the drawings,

FIG. 4A is in a deflected position.

DETAILED DESCRIPTION OF THE INVENTION

Figure 1A:
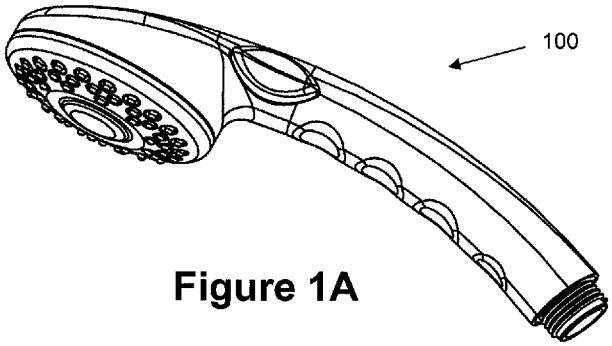
FIG. 1A schematically illustrates an embodiment of a hand shower with an adjustable trajectory spray nozzle.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

The disclosed embodiments utilize a method and apparatus to control a spray pattern produced from a spraying device consisting of a plurality of individual jets that form the resulting spray pattern. The trajectory of each individual jet is controlled by orienting the nozzle-like feature that produces each individual jet, thereby producing a variety of spray patterns. This is accomplished utilizing the flexible properties of elastomeric or rubber-like materials. In addition to allowing for deformation or movement to remove possible obstructions to the fluid flow, this flexibility property also permits for specific, controlled movements whereby it is possible to control the trajectory of the fluid issuing from the device. These rubber-like materials can include specific features that allow the material to be deformed in a controlled fashion so as to predictably position the trajectory of the streams issuing from the individual nozzles.

While rubber or elastomeric materials can generally experience considerably more movement or flex without breakage or damage than other more rigid materials, these materials do have limits of motion if long product life is to be realized. The disclosed embodiments utilize these material limitations and translate this understanding to a novel design.

Figure 1B:
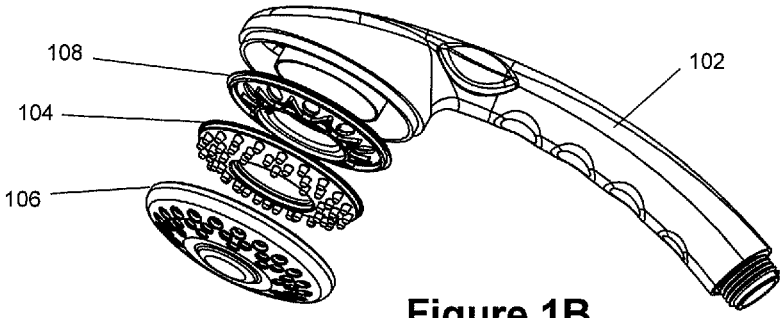
FIG. 1B is an exploded view of the embodiment of the hand shower depicted in FIG. 1A with the lower support member, elastomeric member and upper support member shown in detail.
Figure 1C:
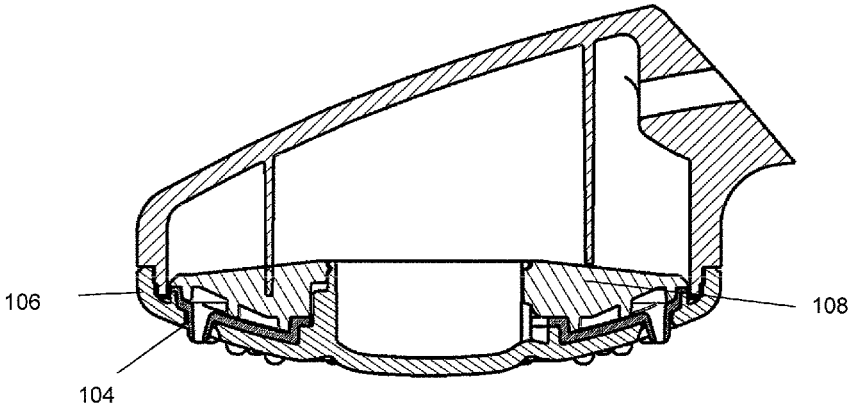
FIG. 1C shows a cross section view thru the head of the shower depicted in FIG. 1A.

Reference is made to FIGS. 1A, 1B and 1C showing a typical application featuring an elastomeric member in a hand shower 100 held by a user with a gripping handle 102. The elastomeric member 104 is assembled on top of a downstream support plate 106. In the current configuration, an upstream support member 108 is provided to contain the elastomeric member fixed in the assembly. The elastomeric member 104 is deformed by the user by contacting the outer portion of the elastomeric member 104.

Figure 2A:
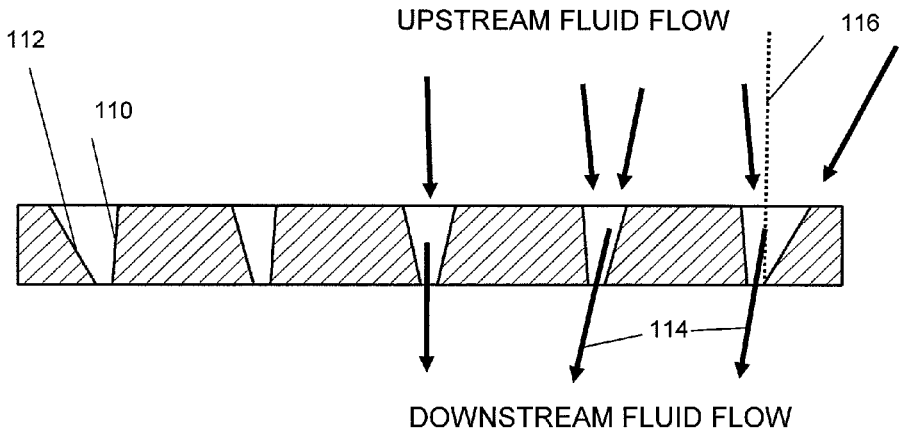
FIG. 2A schematically illustrates the fluid flow thru orifices with angled side walls.
Figure 2B:
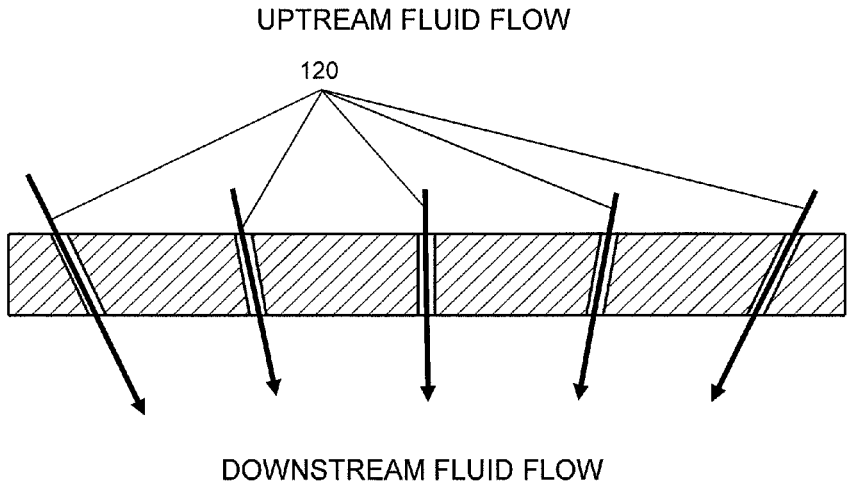
FIG. 2B illustrates the fluid flow thru straight walled orifices whose axes are oriented at an angle to the outer surface of the member with the orifice holes.

The trajectory of streams issuing from a pressurized fluid container can be controlled in a rigid material member by the device shown in FIGS. 2A and 2B. FIG. 2A shows a technique employed in molding parts featuring straight core pulls. The sidewalls of the orifice, shown as 110 and 112, are angled relative to the surface normal, shown as the dashed line 116, but at a positive value of the angle. The trajectory of the issuing stream 114 is at an angle intermediate to the sidewall angles, since this angle of the issuing fluid is determined by the average fluid momentum flux. Another option to control trajectory is to create flow paths thru orifices 120 at the desired trajectory angle as shown in FIG. 2B.

Figure 3A:
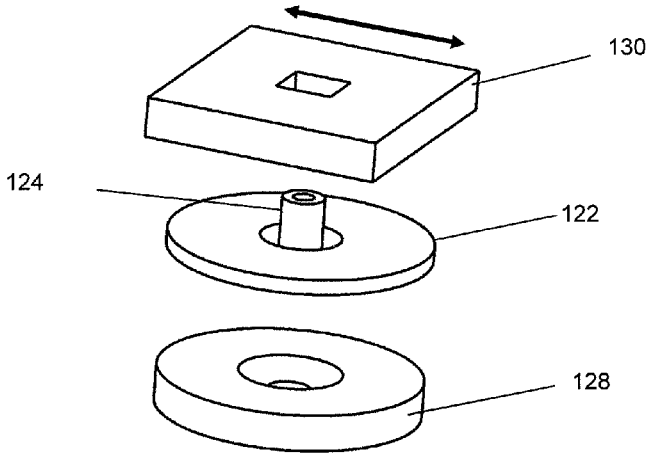
FIG. 3A schematically illustrates an exploded isometric view of the components utilized for controlling the direction of fluid flow thru an elastomeric member by deflecting a boss.
Figure 3B:
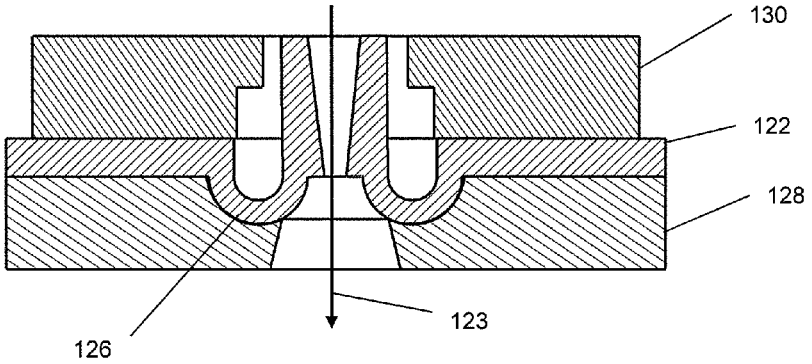
FIG. 3B illustrates the fluid flow direction when the elastomeric member of FIG. 3B is in an undeflected condition.
Figure 3C:
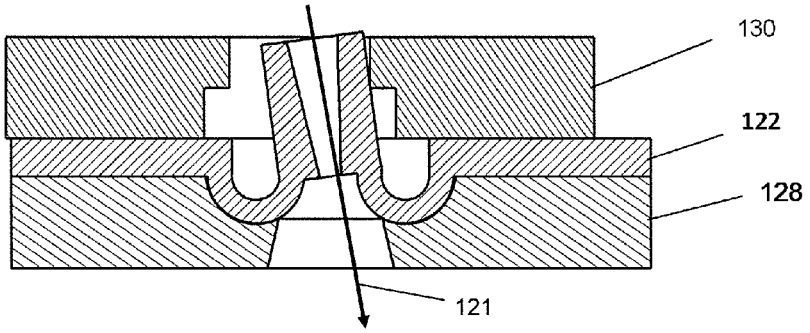
FIG. 3C illustrates the fluid flow direction when the elastomeric member of FIG. 3B is in the deflected position.

The disclosed embodiments control issuing stream trajectories by orienting the flow channel in an elastomeric member 122. Because this member 122 is elastomeric, a flexible flow channel can be created. Reference is made to FIGS. 3A, 3B and 3C for a simplified representation of one such device. The elastomeric member 122 has an upstanding feature, referred to as a boss 124, and a convoluted lower feature 126. The support member 128 supports the elastomeric member 122 against the fluid pressure. Positioned atop the elastomeric member 122 is a moveable member 130 capable of interfering with the boss member 124. When the moveable member 130 is positioned so as not to contact the boss member 124, the fluid trajectory is normal to the flat outer surface of the support member 128 as shown by the arrow 123 in FIG. 3B. However, when the moveable member 130 is positioned to interfere with the boss 124, the fluid trajectory, shown by the arrow 121, is altered to some angle, the value of which will depend upon the resulting deflection and deformation of the boss 124 as shown in FIG. 3C.

Figure 4A:
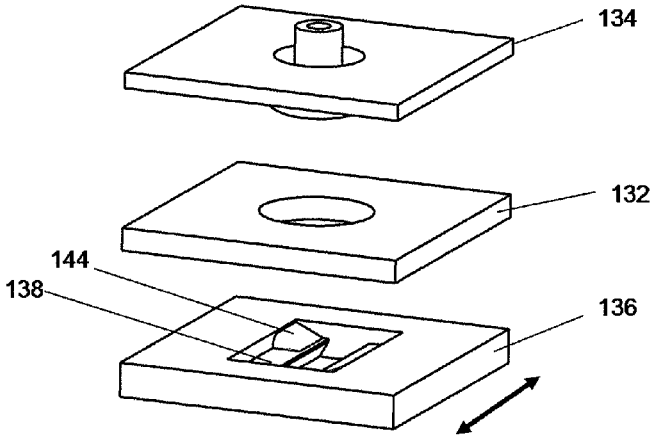
FIG. 4A schematically illustrates another embodiment of an exploded isometric view of a set of components for controlling the direction of fluid flow thru an elastomeric member.
Figure 4B:
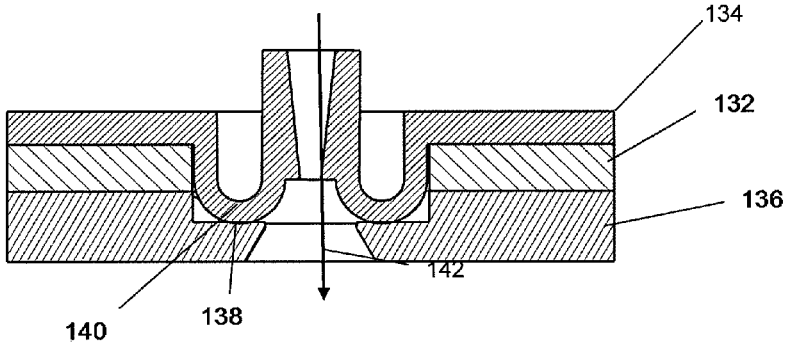
FIG. 4B illustrates the fluid flow direction when the elastomeric member of FIG. 4A is in an undeflected condition.
Figure 4C:
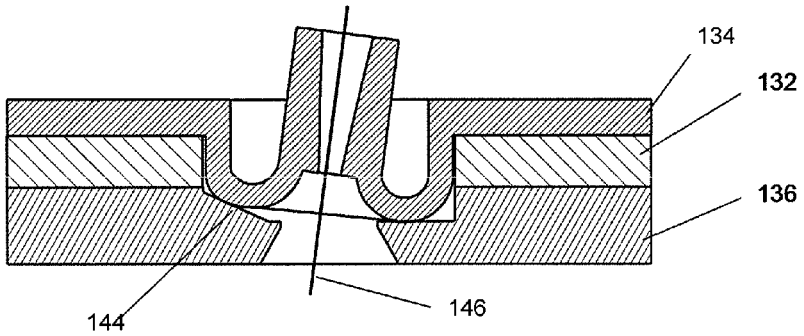
FIG. 4C illustrates the fluid flow direction when the elastomeric member

FIGS. 4A, 4B and 4C show another embodiment to alter the stream trajectory of an elastomeric member 134. In this embodiment, a supporting member 132 provides a method to support the elastomeric member 134 against the internal fluid pressure. Positioned below the supporting member 132, is a moveable member 136 which has a flat surface 138 to support the convoluted surface of the elastomeric diaphragm 140. When the moveable member 136 is positioned so that the flat surface 138 is supporting the convolution 140, there is no deformation of the elastomeric member 134, and the issuing fluid trajectory is as shown by the arrow 142 in FIG. 4B. This moveable member 136 also has a raised feature 144 on its supporting surface 138. When the moveable member 136 is positioned so that the raised surface 144 contacts a portion of the convoluted surface 140, the elastomeric member 134 is deformed or deflected, and the fluid trajectory is altered as shown by the arrow 146 in FIG. 4C. The above disclosure is not limited by the manner in which the elastomeric member is deformed or deflected thereby altering the issuing stream trajectory.

Reference will now be made to FIG. 5 thru FIG. 13 to describe the present embodiments. FIG. 5A schematically illustrates an isometric view of an embodiment of a hand shower. FIG. 5B shows an exploded view of the components of the hand shower in FIG. 5A. A handle 160 is attached to the housing 168 to form the fluid housing, although an integral construction of the handle 160 and housing 168 is an alternative option. Extended bosses 166 integral in the housing 168 align with ribs 164 of the deflecting member 162. When the ribs 164 engage extended bosses 166, the deflecting member 162 is prevented from rotating in the housing 168. An alignment plate 156 is positioned on top of the elastomeric member 154 and serves to provide alignment for the elastomeric member 154. The elastomeric member 154 is positioned on top of the support member 152 which provides a supporting restraint against the fluid pressure. A tab 158 is attached to the support member 152 and provides a method in which the support plate 152 can be rotated. A retaining ring 148, which contacts the outer surface of the support member 152, is attached to the housing 168 via a thread 170, and thereby secures the components into the housing 168. A seal 150, which contacts both support plate 152 and retaining ring 148, prevents leakage of fluid to the outside. FIG. 5C shows a cross section view of the hand shower shown is FIG. 5A. FIG. 5D shows and enlarged view of the cross section view of FIG. 5C. A retaining ring 148 engages the housing 168 via a set of threads 170.

The seal 150 contacts the inside surface of the retaining ring 148 and the outside surface of the support member 152 thereby preventing fluid leakage. A protruding boss 182 on the alignment plate 156 assembles into a recess 178 of the support member 152 and provides a method to align these respective parts. The boss feature 172 of the elastomeric member 154 is positioned in the opening (slot 180) of the alignment plate 156, and between sidewalls of the deflecting member 162. FIG. 5E shows an enlarged partial view of the cross section shown in FIG. 5C. Here a protruding center boss 190 of the deflecting member 162 is positioned into the central recess 192 of the alignment member 156, thereby providing axial alignment for these parts.

Figure 6A:
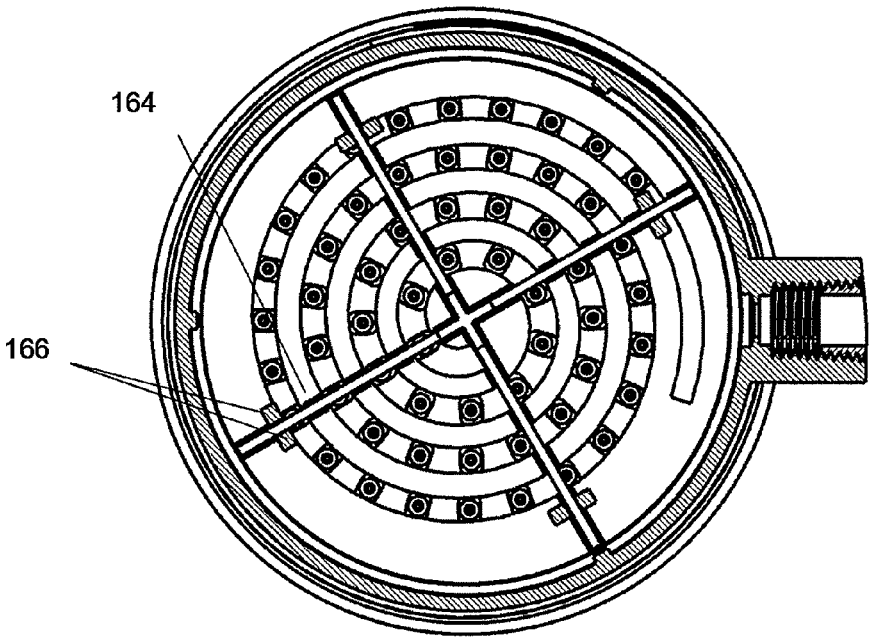
FIG. 6A schematically illustrates a view looking thru the top surface of the shower head with that surface removed.
Figure 6B:
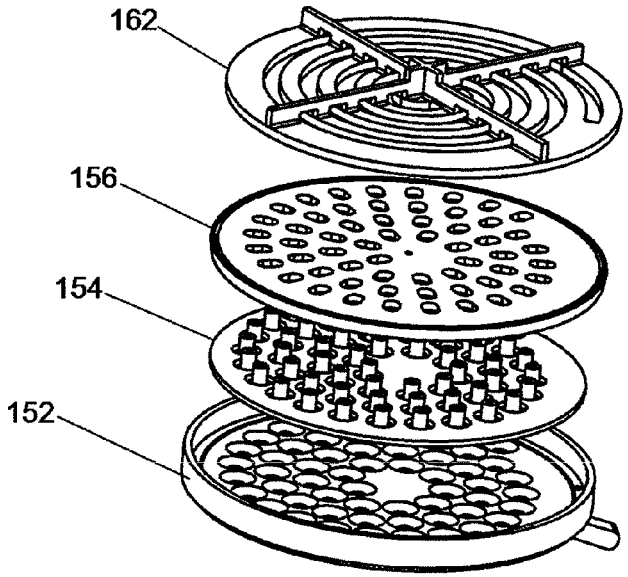
FIG. 6B is an exploded view of the components of FIG. 6A.

FIG. 6A shows the upstream surface of the deflecting member 162 with the top surface of the housing 168 removed. It is shown in this view that ribs 164 of deflecting member 162 are engaged by the protruding ribs 166 of the housing 168. This engagement prevents the rotation of the deflecting member 162 relative to the housing 168. FIG. 6B shows the major components of the disclosed embodiment. The deflecting member 162 is positioned on top of the alignment member 156 which is positioned on top of the elastomeric member 154. The support member 152 provides structural support to the elastomeric member 154.

Figure 7A:
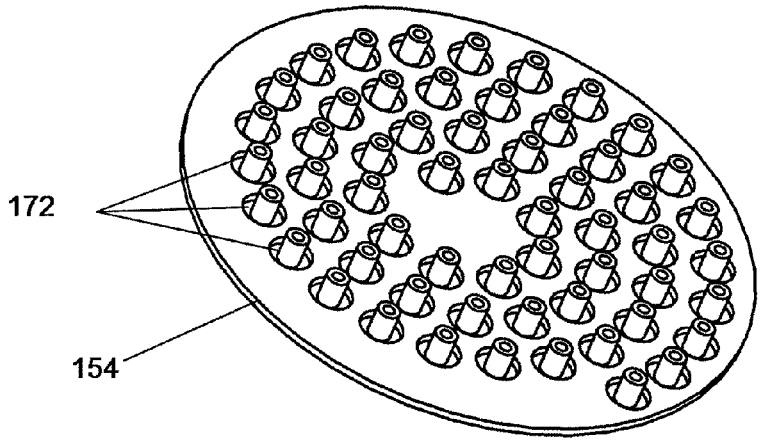
FIG. 7A schematically illustrates an isometric view of the upstream surface of the elastomeric member of the disclosed embodiments.
Figure 7B:
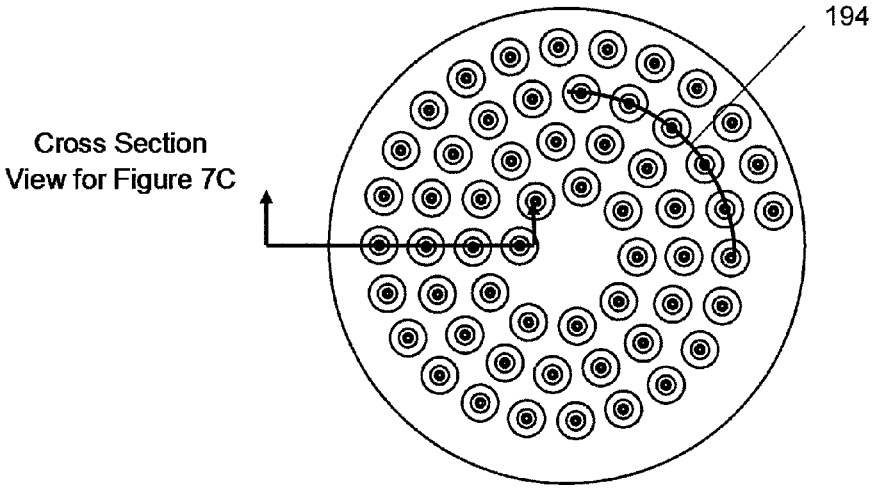
FIG. 7B is a bottom plane view of the downstream surface of the elastomeric member of the disclosed embodiments.
Figure 7C:
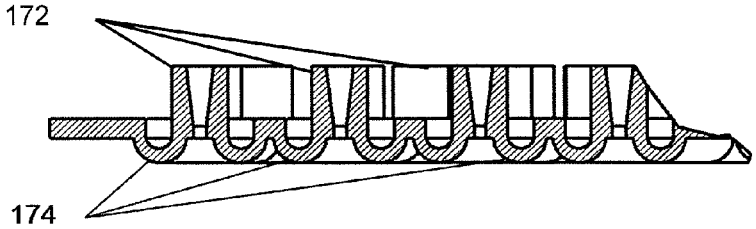
FIG. 7C is a partial cross sectional view of the elastomeric member taken thru the view direction shown in FIG. 7B.

FIG. 7A shows an isometric view of the upstream surface of the elastomeric member 154 with the upward extending bosses 172. FIG. 7B shows a plane view of the upstream surface of the elastomeric member 154. FIG. 7B also shows the spiral path 194 along which each of the boss-like features 172 and convoluted surfaces 174 shown in FIG. 7C are distributed. The boss 172 features allow the flow path to be deflected and the convoluted surfaces 174 allow the boss 172 deflection to occur over a more widely distributed area, thereby reducing stresses incurred during the deflection process. These features are shown in the cross sectional view of FIG. 7C.

Figure 8A:
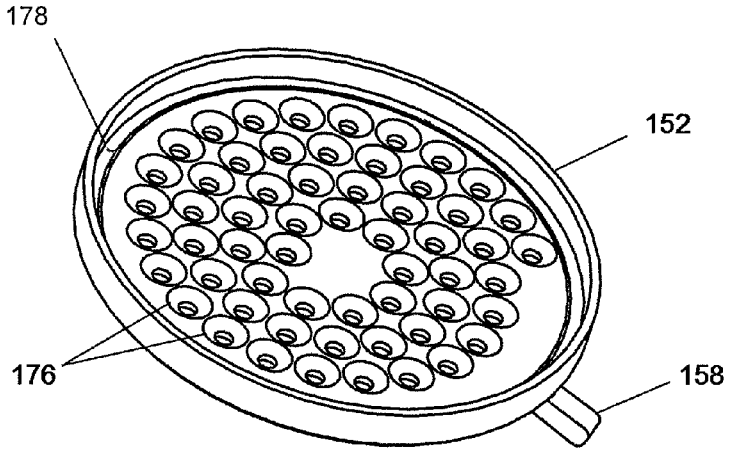
FIG. 8A schematically illustrates an isometric view of the upstream surface of the lower support plate of the disclosed embodiments.
Figure 8B:
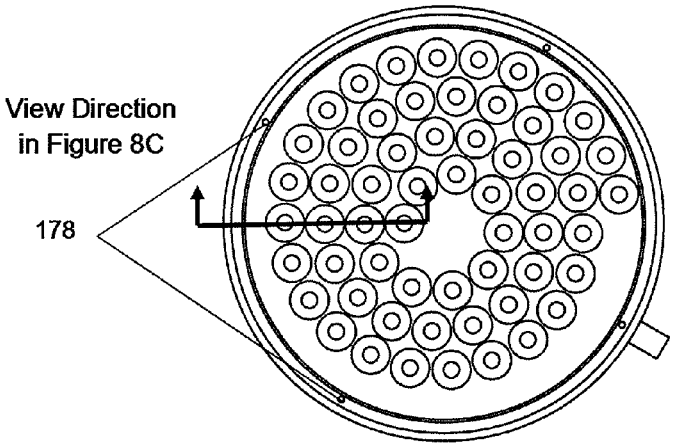
FIG. 8B is a plane view of the upstream surface of the lower support member of the embodiment depicted in FIG. 8A.
Figure 8C:
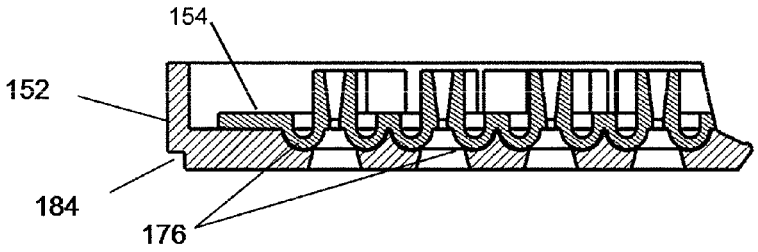
FIG. 8C is a partial cross section view of the embodiment of FIG. 8A, thru the lower support member with the elastomeric member assembled on top of the upstream surface of the support member.

FIG. 8A is an isometric view of the upstream surface of the lower support member 152. FIG. 8A shows the concave recesses 176, which are distributed along the same spiral path 194 as shown in the elastomeric member 154. These concave recesses provide support against the fluid pressure for the convoluted surfaces 174 of the elastomeric member 154. FIG. 8B shows a plane view of the upstream surface of the support lower support member 152. Small recesses or pockets 178 are also seen in FIG. 8B to receive the protruding alignment features 182 of the alignment member 156. FIG. 8C is a cross sectional view of the elastomeric member 154 and the support member 152. Feature 184 is a groove for a sealing member. Concave recesses 176 are shown providing support to the elastomeric member 154.

Figure 9A:
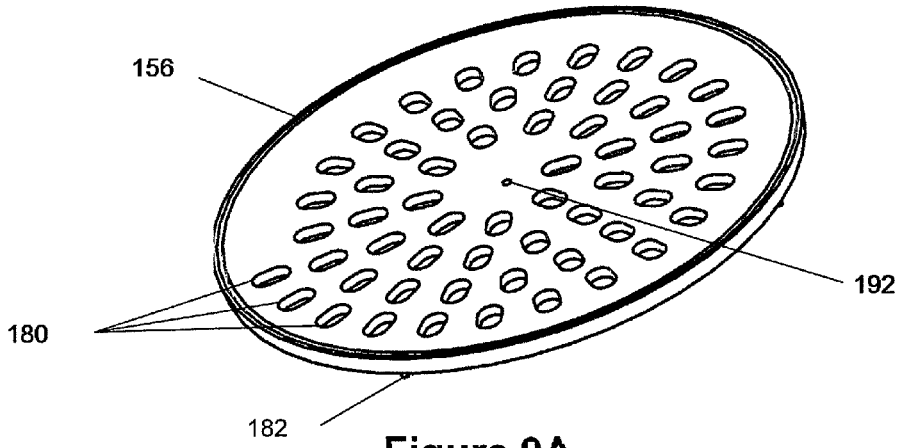
FIG. 9A schematically illustrates an isometric view of the upstream surface of the upper alignment member of the disclosed embodiments.
Figure 9B:
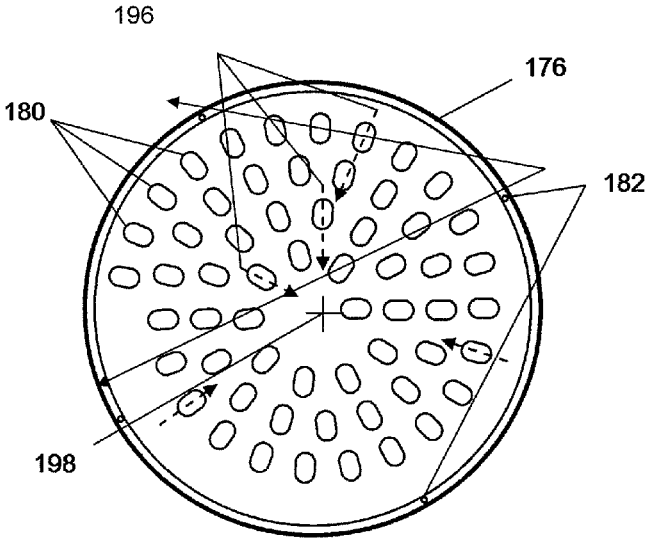
FIG. 9B is a plane view of the upstream surface of the upper alignment member of FIG. 9A.
Figure 9C:
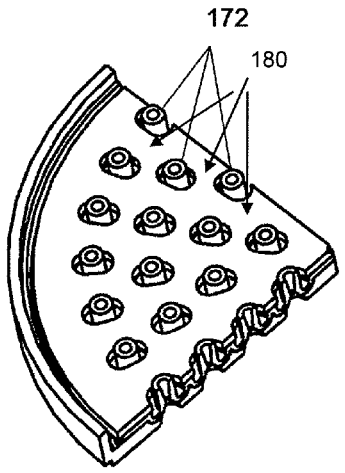
FIG. 9C is an isometric view of a partial cross sectional area taken thru the assembly of the lower support member, elastomeric member, and the upper alignment member of FIG. 9A.

FIG. 9A shows an isometric view of the upstream surface of the alignment member, 156 along with the slotted holes 180 distributed along the same spiral path 194 as that of the elastomeric member 162. Also, a small, cylindrical recess 192 is present at the center of the part and is used to help align the axes of the deflecting member 162 and the alignment member 156. FIG. 9B is a plane view of the downstream surface of the alignment member 156 showing the orientation of these slotted holes 180 such that the centerline axis of the slotted holes, indicated by arrows 196, is pointing toward the center axis 198 of the alignment member 156. Since the bosses 172 of the elastomeric member 154 protrude thru these slots 180, it can be seen that the bosses 172 can only move along the path of this slot 180. This is also illustrated in FIG. 9C. Additionally, FIG. 9B shows four small protruding boss features 182, which assemble into the small recesses 178 of the lower support member 152, thereby locking the alignment plate to the lower support plate and preventing relative rotation between the lower support member 152, the elastomeric member 154, and the alignment member 156.

Figure 10A:
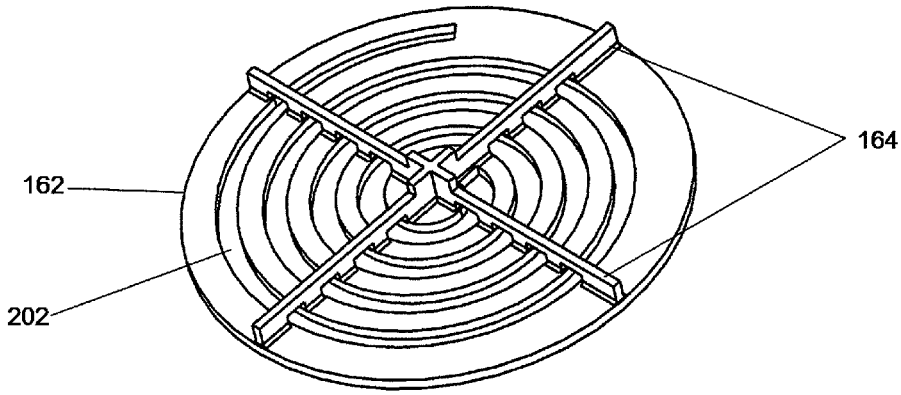
FIG. 10A schematically illustrates an isometric view of the deflecting member of the disclosed embodiments.
Figure 10B:
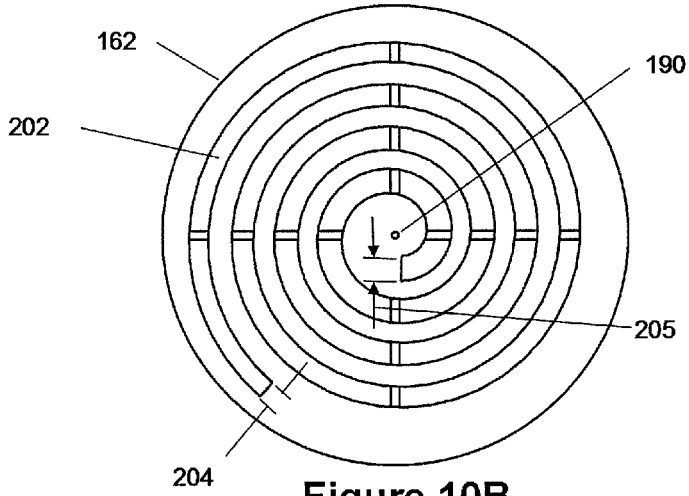
FIG. 10B is a plane view of the downstream surface of the deflecting member of FIG. 10A illustrating a spiral cutout section.
Figure 10C:
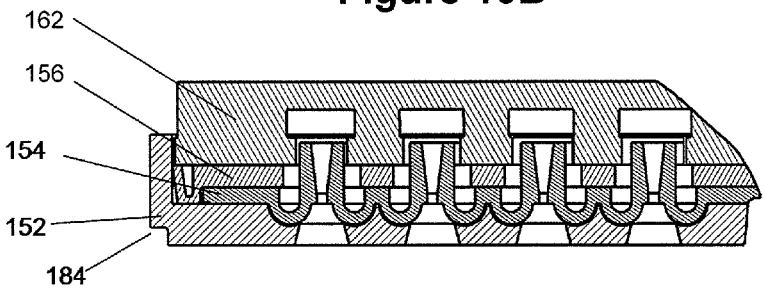
FIG. 10C is a partial cross sectional view of an assembly of the lower support member, the elastomeric member, the upper alignment member and the deflecting member of FIG. 10A.

FIG. 10A illustrates an isometric view of the upstream surface of the deflecting member 162. A slot 202 is present in the deflecting member, and its centerline follows the same spiral path 194 of the elastomeric member 154. Ribs 164 provide means to stiffen the deflecting member 162, as well as a way to prevent rotation when engaged by the extending bosses 166 of the housing 168. As can be seen in FIG. 10B, the width of this slot 204 at the outer most portion is narrower than the width at the inner most portion 205. This variation in width is determined by the design intent, and the result of this variation will become apparent later in the discussion. Also, a small protruding cylindrical boss feature 190 is seen and this boss is assembled into a cylindrical recess feature 192 of the alignment member 156 to provide axes alignment between this member and the deflecting member 162. FIG. 10C is a cross sectional view of the assembly of the lower support member 152, the elastomeric member 154, the alignment member 156 and the deflecting member 162. Feature 184 is the groove for the sealing member 150.

Figure 5A:
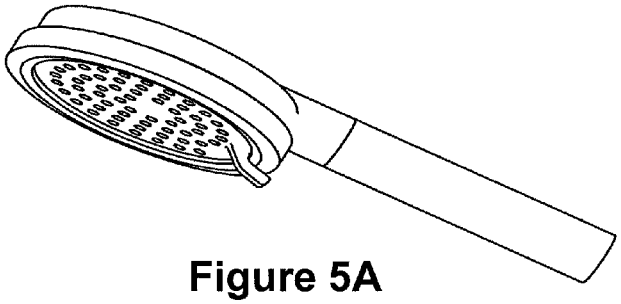
FIG. 5A schematically illustrates an embodiment of an isometric view a hand shower.
Figure 5B:
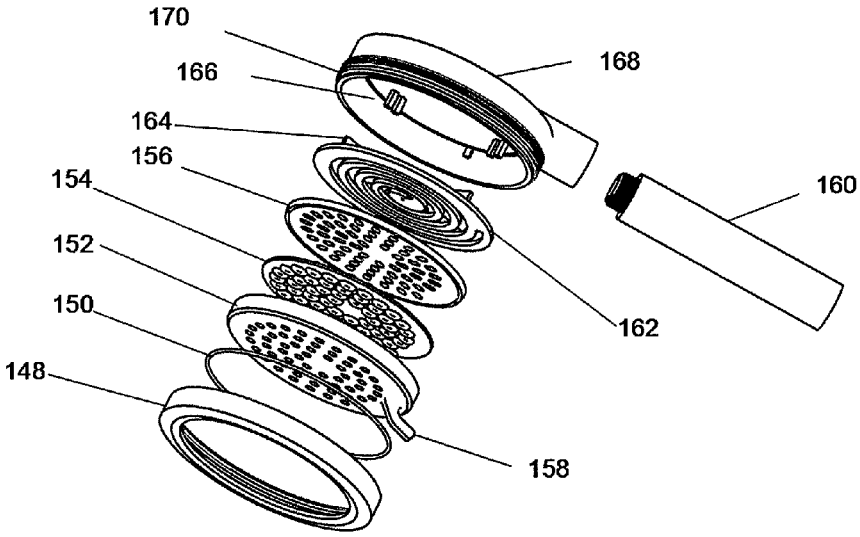
FIG. 5B is an exploded, isometric view of the hand shower FIG. 5A.
Figure 5C:
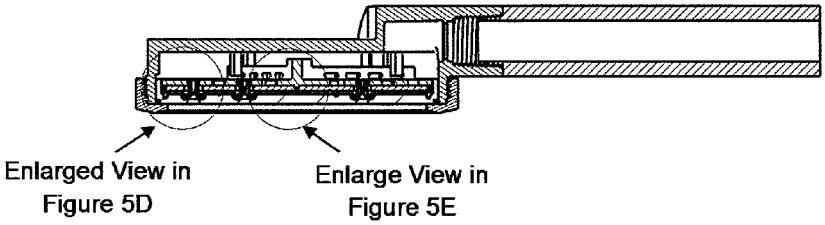
FIG. 5C is a cross section view at mid-plane of the shower product shown in FIG. 5A.
Figure 5D:
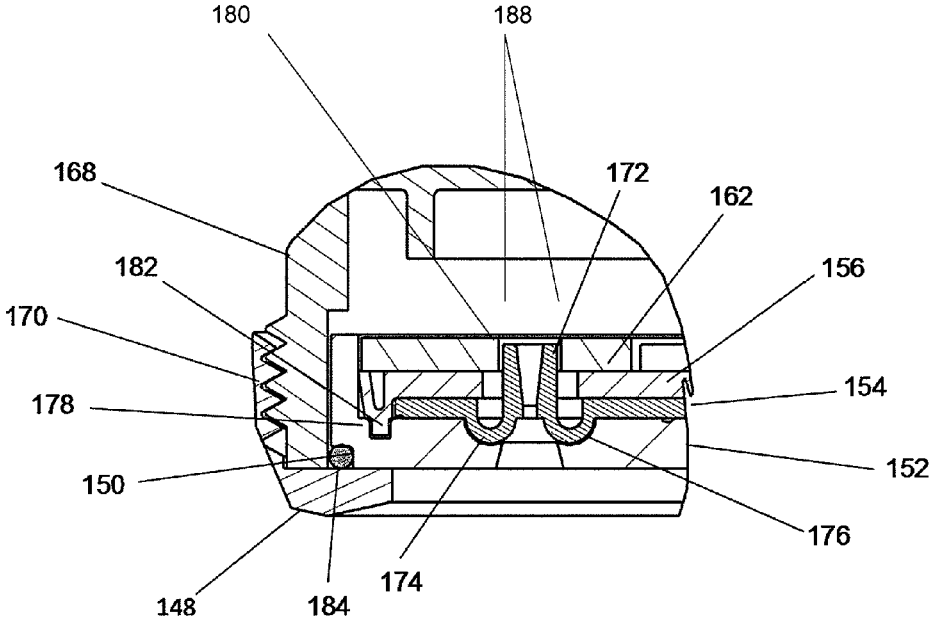
FIG. 5D is an enlarged view of a portion of the cross sectional view of FIG. 5C.
Figure 5E:
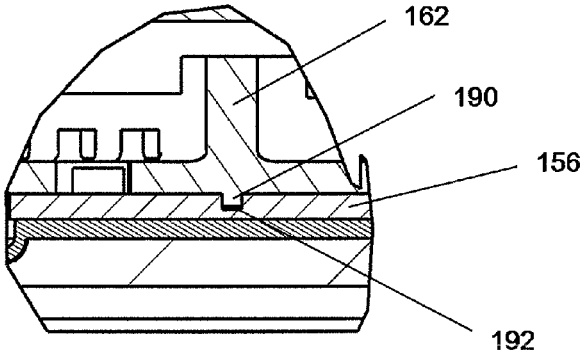
FIG. 5E is an enlarged view of a partial section of the center of the assembly of the embodiment depicted in FIG. 5C.

Reference is now made to FIG. 5D. The elastomeric member 154 is assembled into the lower support member 152, making sure that the convoluted surfaces 174 of the elastomeric member 154 is align with the concave recesses 176 of the support member 152. Assembly in this manner will prevent relative rotation between the two members, 154 and 152. Alignment member 156 is then position so that the bosses 172 of elastomeric member 154 protrude thru the slots 180 in the alignment member, and also that protruding bosses 182 of the alignment member fit into the recesses 178 of the lower support member 152. The deflecting member 162 is also positioned so that the sidewalls of the spiral slot 202 in the deflecting member 162 are not contacting the bosses 172 of the elastomeric member 154, as shown in FIG. 5D. Referring now to FIG. 5E, the deflecting member 162 is then positioned so that the small protruding cylindrical feature 190 of the deflecting member 162 fits into the small cylindrical recess 192 of the lower support plate 152.

Figure 11A:
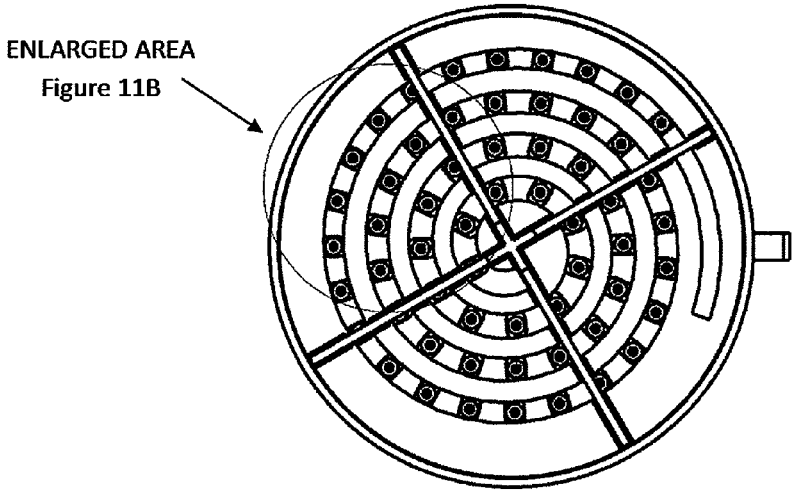
FIG. 11A schematically illustrates a plane view looking at the upstream surface of the deflecting member in the assembly of the lower support member, elastomeric member, upper alignment, and the deflecting member. The Illustration depicts the alignment of the deflecting member so as not to interfere with the upstanding features or bosses of the elastomeric member.
Figure 11B:
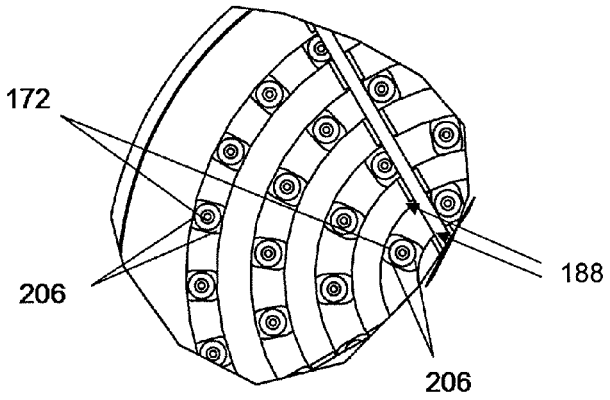
FIG. 11B is an enlarged view of the area detailed in FIG. 11A.
Figure 11C:
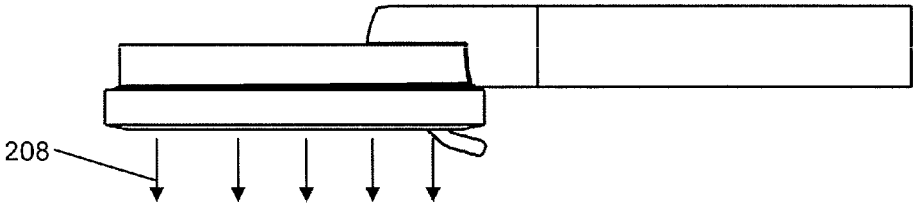
FIG. 11C is a plane view of the hand shower containing the disclosed embodiments with the resulting, approximate trajectory of the issuing fluid streams as shown for the assembly shown in FIG. 11A.

FIG. 11B shows this alignment, as there is clearance between the boss 172 surfaces and the sidewalls 188 of the spiral slot as shown at locations 206. The ribs 164 of the deflecting plate are then oriented so as to fit between the protruding features 166 of the housing, 168 as the assembly is inserted into the housing 168 as shown in FIG. 6A. This assembly prevents relative rotation between the deflecting member 162 and the housing 168. The lower support plate 152, elastomeric member 154 and upper alignment member 156 are still free to rotate as an assembly, with the rotation occurring at the interface between the upstream surface of the alignment member 156 and the downstream surface of the deflecting member 162. Seal member 150 is then positioned in the groove 184 of the lower support plate 152 and this assembly is then held in place as the retaining ring 148 is assembled to the thread 170 of the housing 168.

Actual operation of the disclosed invention is described as follows. When then deflecting member 162 is oriented relative to the elastomeric member 154, such that there is no contact between the spiral slot sidewall surfaces 188 in the deflecting member 162 and the bosses 172, the bosses 172 maintain their natural alignment. In this case the issuing fluid flow trajectory is in a direction normal to outer face of the lower support member 152 and is shown by the arrows 208 in FIG. 11C.

Figure 12A:
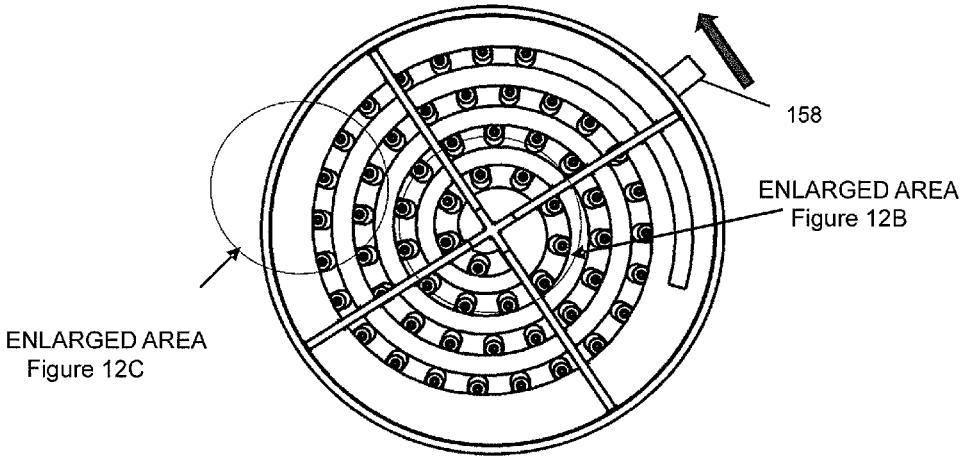
FIG. 12A schematically illustrates a plane view looking at the upstream surface of the deflecting member in the assembly of the lower support member, elastomeric member, upper alignment member, and the deflecting member with the tab on the lower product support member being rotated counter clockwise.
Figure 12B:
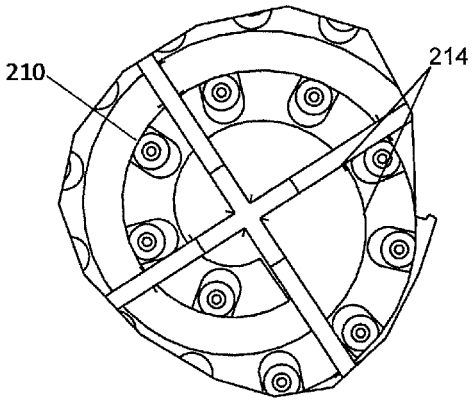
FIG. 12B is an enlarged view of the inner most bosses in the elastomeric member and FIG. 12C is an enlarged view of the outer most bosses in the elastomeric member of FIG. 12A.
Figure 12C:
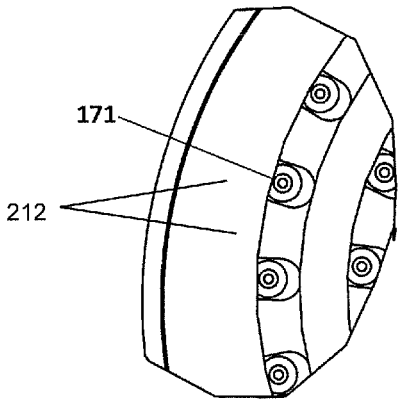
Figure 12D:
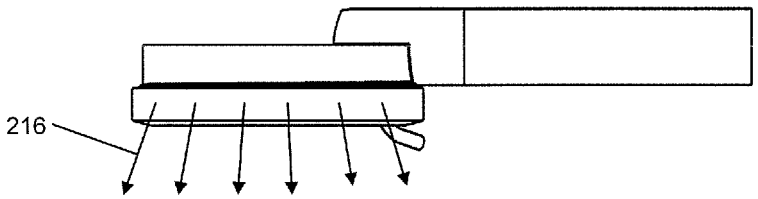
FIG. 12D is a plane view of an embodiment view of the hand shower with the resulting, approximate trajectory of the issuing fluid streams as shown with the lever of the lower support member rotated as shown in FIG. 12A.

If the tab 158 of the lower support member 152 is rotated in a counter clockwise direction, as shown in FIG. 12A, the sidewall surfaces 188 of the spiral slot 202 will begin to contact the surfaces of the outer-most bosses 212 of the elastomeric member 154. Since the outer-most portion of the slot 204 is narrower than the inner portion 205, contact will first be made with the outer-most bosses 212. With continued rotation of the deflecting member 154, the outer-most bosses 212 will experience greater contact as indicated by the regions of interference 171 when compared to the contact at region 210 as shown in FIGS. 12B and 12C. As a result of this greater contact and interference, the outer bosses 212 will undergo a greater deflection than the innermost bosses, 214. Because of the presence of the alignment member 156, the bosses 172 can only move in a direction along the slots 180. As a result, the upper ends of the bosses 172 are deflected toward the center of the assembly, which further results in the effective flow axis of the bosses 172 being angled away from the center axis, with the outer-most bosses' 212 axes having a greater angular change than the inner bosses 214. The resulting trajectory of the issuing streams will be as shown by the arrow 216 in FIG. 12D.

Figure 13A:
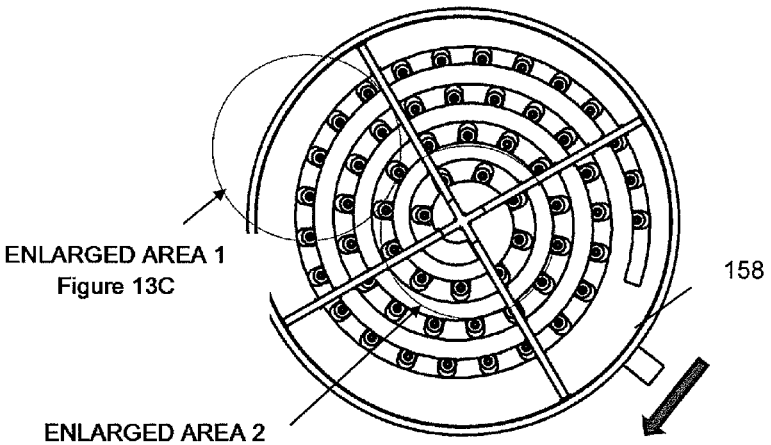
FIG. 13A schematically illustrates a plane view looking at the upstream surface of the deflecting member in the assembly of the lower support member, elastomeric member, upper alignment member, and the deflecting member with the tab on the lower support member being rotated in a clockwise direction.
Figure 13B:
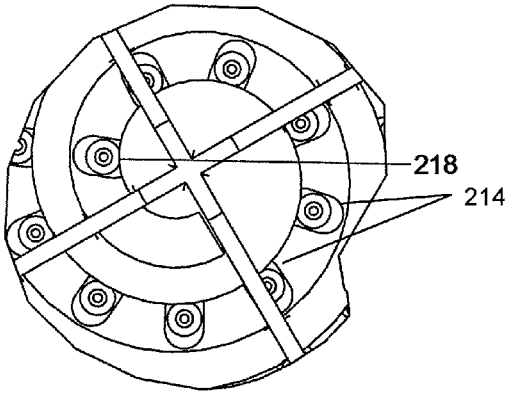
FIG. 13B is an enlarged view of the inner most bosses in the elastomeric member.
Figure 13C:
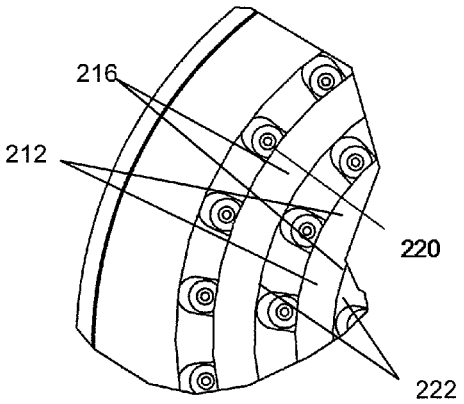
FIG. 13C is an enlarged view of the outer most bosses in the elastomeric member of FIG. 13A.
Figure 13D:
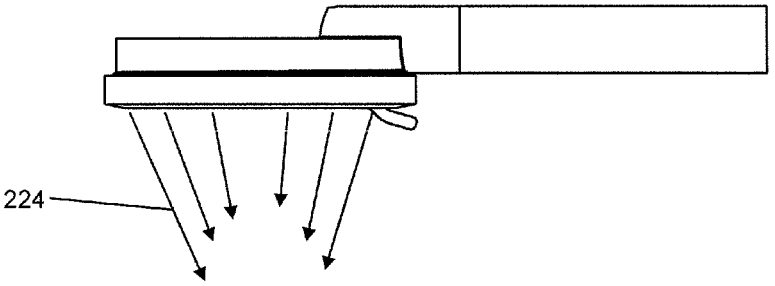
FIG. 13D is a plane view of an embodiment of the hand shower with the resulting, approximate trajectory of the issuing fluid streams as shown with the lever of the lower support member rotated as shown in FIG. 13A.

If the tab 158 of the lower support member 152 is rotated in a clockwise direction as shown in FIG. 13A, the sidewall surfaces 216 of the spiral slot 202 will begin to contact the inside surfaces 222 of the outer-most bosses 212 of the elastomeric member 154. Since the outermost portion of the slot 204 is narrower than the inner portion 205, contact will first be made with the outer-most bosses 212. With continued rotation of the deflecting member 162, the outer-most bosses 212 will experience greater contact as indicated by the region of interference shown as 220 in FIG. 13C as compared to the region of interference 218 shown in FIG. 13B. As a result, the outer most bosses 212 will undergo a greater deflection. Again, because of the presence of the alignment member 156, the bosses can only move in a direction along the slots 180. This also results in the upper end of the bosses 172 being deflected away from the center of the assembly. Thus, the effective flow axis of the bosses 172 is being angled toward the center axis, with the outer most bosses' 212 axes having a greater angular change than the inner bosses 214. This allows the stream to be directed to converge at a point at some chose distance from the face of the lower support member 152. The resulting trajectory of the issuing streams will be as shown by the arrows 224 in FIG. 13D.

Figure 14A:
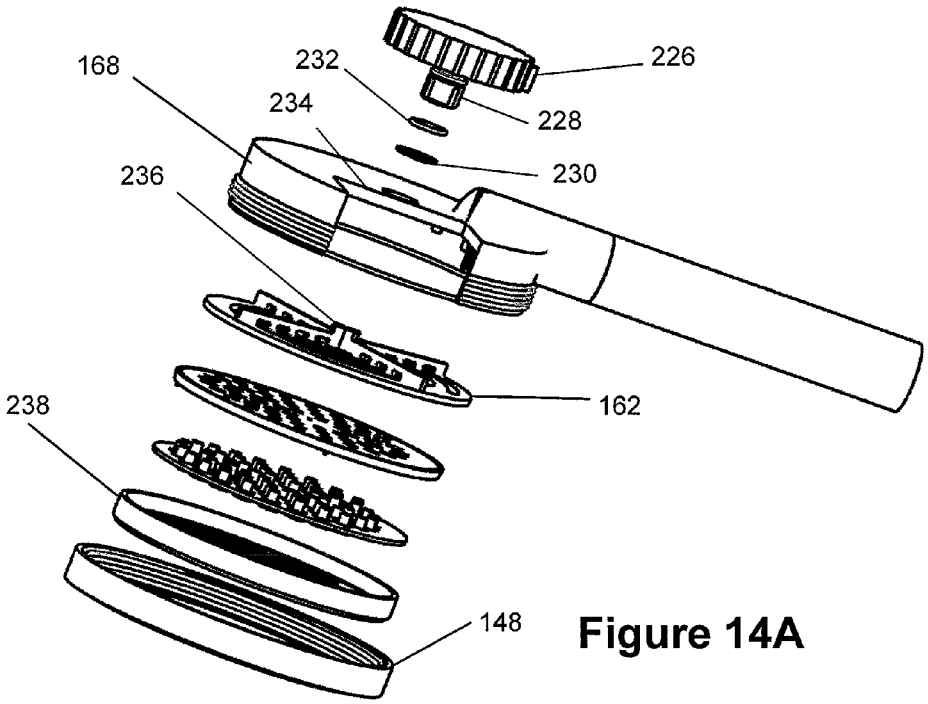
FIG. 14A schematically illustrates another embodiment of a hand shower. In this embodiment, an exploded isometric view, with a small cutaway section, depicts an embodiment where the relative movement between a deflecting member and an elastomeric member is achieved by using a knob to rotate the deflecting member.
Figure 14B:
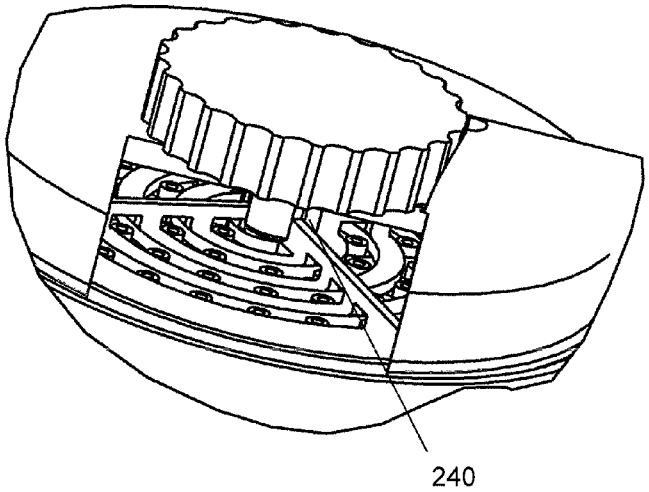
FIG. 14B illustrates an isometric view of a cutaway of the hand shower showing the engagement between the knob and the deflecting member of FIG. 14A.

The previously disclosed embodiments utilize a design where a deflecting member is held in a stationary position, and a lower support member can be rotated to produce a deflection to the boss thereby changing the issuing stream trajectories. FIG. 14A discloses an alternative embodiment where the deflecting member 236 is rotated by a knob 226 assembled thru a hole 234 in the back of the housing 168. In this example, the lower support member 238 would not be required to rotate. The retaining ring 230 is used to restrain the knob 226 in position in the housing. A seal 232 would be utilized to prevent leakage around the knob stem 228. FIG. 14B illustrates a method by which the slot 240 in the knob 226 could engage the intersection of the deflecting plate ribs 236, thereby allowing the knob 226 to rotate the deflecting plate 162.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. A fluid spray control device that produces a variety of fluid spray patterns comprising:

a housing that forms an enclosed flow path interface between a pressurized fluid source and a flexible member comprising a disk containing a plurality of flexible flow channels aligned along a continuous, non-closing path, said flexible flow channels each having an inlet, a protruded cylindrical axis with a length which is greater than diameter, and an outlet thereby forming individual nozzles that extend beyond the distal surface of said disc;

a manifold within said housing that supplies said fluid into said nozzles;

a rigid support plate that supports and retains said flexible member with said manifold;

a variable position deflecting member oriented to, and aligned with, said continuous non-closing path of said flexible flow channels that contacts some or all of said flexible flow channels to deflect the direction of said contacted flow channels as a unit, from an inward radial position to an outward radial position relative to a centerline of said device, thereby allowing a user to alter the angle of trajectory of said fluid in a continuous manner from a converging to diverging spray by rotating said deflecting member while said fluid is issuing from said nozzles, wherein said deflecting member contacts a base surface of said flexible flow channels;

an alignment member that contacts said flexible flow channels and allows limited and specific deflection angles and position of said flexible flow channels;

a lower support member that retains said alignment member, said deflecting member, said rigid support plate and said manifold with said housing.

2. The device of claim 1, wherein said flexible member is an elastomeric compound.

3. The device of claim 1, wherein said flexible flow channels are approximately cylindrical shaped.

4. The device of claim 1, wherein said flexible flow channels are approximately conical shaped.

5. A fluid spray control device that produces a variety of fluid spray patterns comprising:

a housing that forms an enclosed flow path interface between a pressurized fluid source and a flexible member comprising a disk containing a plurality of flexible flow channels aligned along a continuous, non-closing path, said flexible flow channels each having an inlet, a protruded cylindrical axis with a length which is greater than diameter, and an outlet thereby forming individual nozzles that extend beyond the distal surface of said disc;

a manifold within said housing that supplies said fluid into said nozzles;

a rigid support plate that supports and retains said flexible member with said manifold;

a variable position deflecting member oriented to, and aligned with, said continuous non-closing path of said flexible flow channels that contacts some or all of said flexible flow channels to deflect the direction of said contacted flow channels as a unit, from an inward radial position to an outward radial position relative to a centerline of said device, thereby allowing a user to alter the angle of trajectory of said fluid in a continuous manner from a converging to diverging spray by rotating said deflecting member while said fluid is issuing from said nozzles;

an alignment member that contacts said flexible flow channels and allows limited and specific deflection angles and position of said flexible flow channels;

a lower support member that retains said alignment member, said deflecting member, said rigid support plate and said manifold with said housing; and, a spiral slot that bounds a lateral portion of at least a portion of said flexible flow channels of said plurality of flexible flow channels, whereby a rotation of said deflecting member changes the orientation of multiple said flow channels resulting in a change in pattern of said angle of trajectory of said fluid exiting said nozzles.

6. A method of producing a variety of fluid spray patterns that issue from a plurality of flexible nozzles comprising:

introducing a fluid under pressure to a manifold that distributes said fluid to a flexible member;

supporting and retaining said flexible member to said manifold with a rigid support plate;

flowing said fluid through said plurality of flexible flow channels in said flexible member;

producing a first fluid spray pattern of said fluid exiting said nozzles with said flexible flow channels aligned along a continuous, non-closing path, each having an inlet, a protruded cylindrical axis with a length which is greater than diameter, and an outlet thereby forming individual nozzles;

contacting some or all of said flexible flow channels with a variable position deflecting member oriented to, and aligned with, said continuous non-closing path of said flexible flow channels;

deflecting some or all of said flow channels from an inward radial position to an outward radial position relative to a centerline of said device, in a continuous manner from a converging to diverging spray by rotating said deflecting member while said fluid is issuing from said plurality of flexible nozzles;

deflecting some or all of said flexible flow channels with said deflecting member on a base surface of said flexible flow channel.

7. A method of producing a variety of fluid spray patterns that issue from a plurality of flexible nozzles comprising:

introducing a fluid under pressure to a manifold that distributes said fluid to a flexible member;

supporting and retaining said flexible member to said manifold with a rigid support plate;

flowing said fluid through said plurality of flexible flow channels in said flexible member;

producing a first fluid spray pattern of said fluid exiting said nozzles with said flexible flow channels aligned along a continuous, non-closing path, each having an inlet, a protruded cylindrical axis with a length which is greater than diameter, and an outlet thereby forming individual nozzles;

contacting some or all of said flexible flow channels with a variable position deflecting member oriented to, and aligned with, said continuous non-closing path of said flexible flow channels;

deflecting some or all of said flow channels from an inward radial position to an outward radial position relative to a centerline of said device, in a continuous manner from a converging to diverging spray by rotating said deflecting member while said fluid is issuing from said plurality of flexible nozzles; and, rotating said deflecting member to engage and deflect some or all of said flexible flow channels with a spiral slot that bounds a lateral portion of at least a portion of said flexible flow channels of said plurality of flexible flow channels.

8. The device of claim 5, wherein said flexible member is an elastomeric compound.

9. The device of claim 5, wherein said flexible flow channels are approximately cylindrical shaped.

10. The device of claim 5, wherein said flexible flow channels are approximately conical shaped.

* * * * *